US005959599A

United States Patent [19]

Hirakata

[11] Patent Number: 5,959,599

[45] Date of Patent: Sep. 28, 1999

[54] ACTIVE MATRIX TYPE LIQUID-CRYSTAL DISPLAY UNIT AND METHOD OF DRIVING THE SAME

[75] Inventor: Yoshiharu Hirakata, Kanagawa, Japan

[73] Assignee: Semiconductor Energy Laboratory Co., Ltd., Kanagawa-ken, Japan

[21] Appl. No.: 08/742,404

[22] Filed: Nov. 4, 1996

[30] Foreign Application Priority Data

Nov. 7, 1995 [JP] Japan ..... 7-313626

[51] Int. Cl.[6] ..... G09G 3/18

[52] U.S. Cl. ..... 345/92; 345/96; 349/48

[58] Field of Search ..... 345/87, 92, 93, 345/94, 95, 96, 204, 208, 209, 210; 349/41, 42, 48, 47

[56] References Cited

U.S. PATENT DOCUMENTS 4,393,380 7/1983 Hosokawa et al. ..... 345/92
4,936,656 6/1990 Yamashita et al. ..... 345/92
5,012,228 4/1991 Masuda et al. ..... 345/92
5,436,635 7/1995 Takahara et al. ..... 345/96
5,473,451 12/1995 Kazurov et al. ..... 345/93

*Primary Examiner*—Lun-Yi Lao
*Attorney, Agent, or Firm*—Fish & Richardson P.C.

[57] ABSTRACT

A data signal having a single polarity is outputted from a data driver of an in-plane switching type liquid-crystal display unit. In a unit pixel, an input transistor and an exhaust transistor T2 are connected to one electrode of a liquid-crystal element LC, and an input transistor and an exhaust transistor are connected to the other electrode. One input transistor and one exhaust transistor connected to the same scanning line are paired, and another input transistor and another exhaust transistor connected to another same scanning line are paired. Those paired transistors are alternately driven, thereby being capable of inverting the potential between electrodes of the liquid-crystal element even when the polarity of the data signal is single.

12 Claims, 6 Drawing Sheets

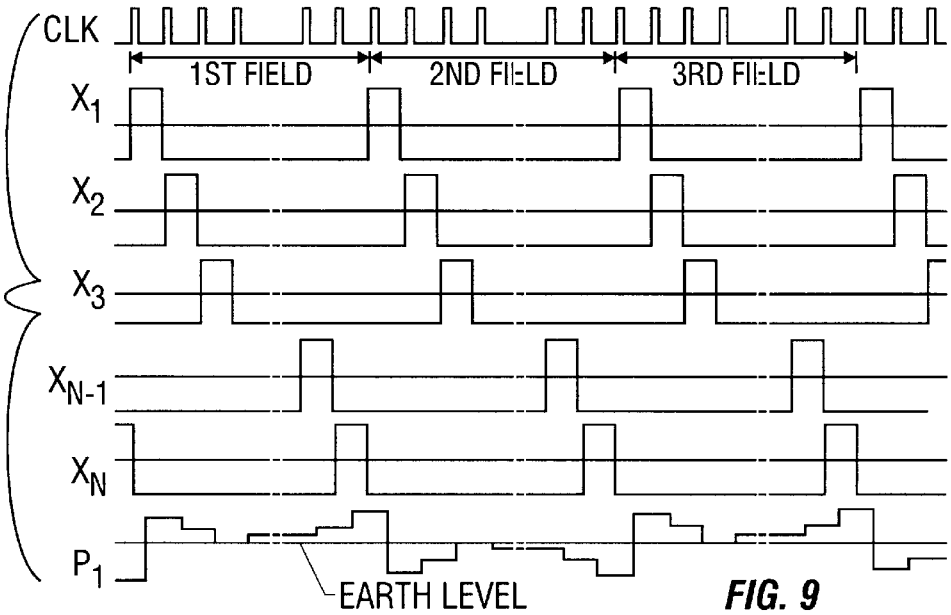
FIG. 9
(PRIOR ART)
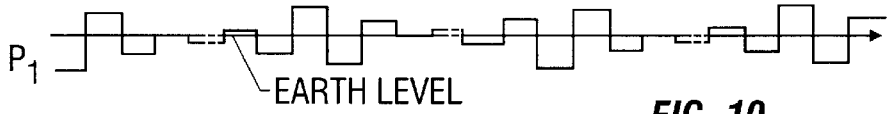
FIG. 10
(PRIOR ART)
FIELD (FRAME) INVERSION
| | | | | | | | | | |
|---|---|---|---|---|---|---|---|---|---|
| + | + | + | + | + | + | + | + | + | + |
| + | + | + | + | + | + | + | + | + | + |
| + | + | + | + | + | + | + | + | + | + |
| + | + | + | + | + | + | + | + | + | + |
| + | + | + | + | + | + | + | + | + | + |
| + | + | + | + | + | + | + | + | + | + |
FIG. 11A
LINE INVERSION
| | | | | | | | | | |
|---|---|---|---|---|---|---|---|---|---|
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
FIG. 11B
LINE INVERSION
| | | | | | | | | | |
|---|---|---|---|---|---|---|---|---|---|
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
FIG. 11C
DOT INVERSION
| | | | | | | | | | |
|---|---|---|---|---|---|---|---|---|---|
| + | − | + | − | + | − | + | − | + | + |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
FIG. 11D

ACTIVE MATRIX TYPE LIQUID-CRYSTAL DISPLAY UNIT AND METHOD OF DRIVING THE SAME

BACKGROUND OF THE INVENTION

1. Field of the Invention

The present invention relates to an active matrix type liquid-crystal display unit which is so intended as to suppress a fluctuation in potential of a signal (data), thereby reducing a power consumption. Also, the present invention relates to a display method for an active matrix type liquid-crystal display unit using an in-plane switching mode which is also called "IPS".

2. Description of the Related Art

In a liquid-crystal display unit, the inversion of a voltage applied to a liquid-crystal element has been required. This operation is conducted to prevent the deterioration of display such as after-image phenomenon because the deterioration of material such as liquid crystal or orientation film, or parasitic charges by impurities are caused in case of applying an electric field having a single polarity for a long time. This operation is called "a.c. operation", and one inversion has been required for one frame (field) or several frames. For the operation, there have existed a variety of systems such as the inversion of a frame (field inversion) in which an entire display screen of one frame has the same polarity (FIG. 11A), a line inversion in which the polarity for one line is the same line but the polarity for a line is different from that for adjacent lines (FIGS. 11B and 11C), a dot inversion in which all pixels adjacent to each other are different in polarity from each other (FIG. 11D), and so on.

Up to now, in order to conduct the above inversion, a signal for inverting the polarity has been supplied to pixels from a data driver (signal driver). FIG. 8 shows a unit pixel for a conventional active matrix type liquid-crystal display unit in which a thin-film transistor (T) is controlled by a signal from a scanning line Xn, and a signal from a data line (Pm) is sent to a liquid-crystal element (LC), and an auxiliary capacity (C) which is disposed in parallel with the liquid-crystal element if required so that charges are stored in an on-state (FIG. 8).

A drive signal for a display unit in which the unit pixels of the above type are disposed in the form of a matrix is shown in FIG. 9. In the figure, CLK is a clock signal (synchronous signal) which represents a minimum time for the display unit. A signal is produced in accordance with CLK. Pulses are sequentially applied to scanning lines ($X_1$, $X_2$, $X_3$, . . . $X_{N-1}$, $X_N$) as shown in the figure. Data corresponding to image signals for each line are applied to a data line $P_1$. This shows an example of the field inversion (FIG. 11A). For comparison, image information is set to be always identical with each other. In other words, 2nd-field data is to invert 1st-field data with respect to an earth level. The same is applied to 2nd-field data and 3rd-field data. An example of data of the line inversion (FIG. 11C) is shown in FIG. 10. Comparing data corresponding to each line, the 1st field is inverse in polarity to the 2nd field.

The conventional liquid-crystal display unit conducts display by applying a voltage vertical to substrates between the substrates, whereas the above display unit conducts display by applying a voltage parallel to a substrate plane within a substrate. The drive system of this type is called "in-plane switching (IPS)". The fundamental concept in the case where the above system is applied to the active matrix type liquid-display unit using a thin-film transistor as a switching element is disclosed in Japanese Patent Examined Publication No. Sho 63-21907.

In addition, the application of the above system is also disclosed in Japanese Unexamined Patent Publication No. Hei 7-43744, Japanese Unexamined Patent Publication No. Hei 7-43716, Japanese Unexamined Patent Publication No. Hei 7-36058, Japanese Unexamined Patent Publication No. Hei 6-160878, Japanese Unexamined Patent Publication No. Hei 6-202073, Japanese Unexamined Patent Publication No. Hei 7-134301, and Japanese Unexamined Patent Publication No. Hei 6-214244. Further, the application of the above system to a simple matrix type liquid-crystal display unit is disclosed in Japanese Unexamined Patent Publication No. Hei 7-72491, and the application of the above system to an active matrix type liquid-crystal display unit having a thin-film diode as a switching element is disclosed in Japanese Unexamined Patent Publication No. Hei 7-120791.

The principle of the IPS system disclosed in the above publications will be described in brief with reference to FIG. 6 and FIG. 7. FIG. 6 shows a unit pixel for the active matrix type liquid-crystal display unit using the IPS system. As in the normal active matrix type liquid-crystal display unit, a plurality of data lines 1 and a plurality of scanning lines 2 are disposed in the form of a matrix. In addition, a plurality of earth lines 3 (earth line or opposite electrode line) are disposed. In the conventional display unit, because electrodes for an opposite substrate are disposed, no earth lines 3 are required. On the other hand, since there are disposed no electrodes for the opposite substrate in the IPS system, there is required the provision of wiring having the same function as that of such electrodes for the opposite substrate.

The earth lines 3 are normally held constant in potential. Also, because the earth lines 3 are formed together with the scanning lines 2, the former does not intersect with the latter, that is, a parallel structure is provided. This is because a part of the earth lines 3 is partially overlapped to a part of pixel electrodes 4 which are formed together with the data lines 1 in such a manner that auxiliary capacities (C) are formed. In other words, the scanning lines 2 and the earth lines 3 are formed simultaneously, and the data lines 1 and the pixel electrodes 4 are formed simultaneously. TFTs 5 each having a part of the scanning line 2 as a gate electrode are formed as shown in the figure. A source of each TFT 5 is in contact with the date line 1, and a drain thereof is in contact with the pixel electrode 4 (FIG. 6).

With such a structure that the earth lines 3 are disposed to be opposite to the pixel electrode 4, an electric field is developed between the pixel electrode 4 and the earth line 3 as indicated by arrows. Liquid-crystal molecules are, as indicated by a in FIG. 7, initially oriented with a given angle, for example, 45° with respect to an intended electric field. Then, upon the application of an electric field, the liquid-crystal molecules are intended to be in parallel to the electric field, as indicated by b in FIG. 7. Well using the inclination of the liquid-crystal molecules, variable density can be expressed. The above is the principle of the IPS system (FIG. 7).

As described above, the conventional active matrix type liquid-crystal display unit requires that data having variation twice as much as the variation of a signal required by only image information is produced by a driver. In other words, although there is merely required that an effective voltage of 5 V is applied to liquid crystal, a drive capability in a range of 10 V which is from +5 V to −5 V has been required because of the necessity of inversion. This leads to the largest obstruction to a reduction of the drive voltage of the driver and a reduction of power consumption.

Likewise, the above display unit suffers from such problems as the destroy of a transistor and the deterioration of characteristics, which are caused by applying an excessive voltage to the active matrix circuit.

SUMMARY OF THE INVENTION

The present invention has been made to solve the above problems with the conventional display unit, and therefore an object of the present invention is to provide the structure of a liquid-crystal display unit that conducts necessary inversion while making the variation of data minimum as required, and a method of driving the display unit.

Also, the conventional IPS system is so designed that the orientation of liquid crystal is in parallel to a substrate with the feature that an angle of visibility is wider than that in the conventional liquid-crystal display unit. However, the above prior art does not particularly pay an attention to the reduction in a load of the data driver, and data is identical to that of the conventional system.

Another object of the present invention is to invert an electric field applied to liquid-crystal molecules without inversion of polarity for data, using the feature of the IPS system that a voltage is mainly applied within the same plane.

In order to solve the above problem, according to a first aspect of the present invention, there is provided an active matrix type liquid-crystal display unit, comprising:

a pair of first and second electrodes holding liquid crystal therebetween;

polarity control means including a circuit which is connected to said first and second electrodes, alternately supplies an image write signal to any one of said first and second electrodes in a predetermined period, and sets the other electrode to a reference potential, to conduct display according to the image signal of a single polarity.

Also, in order to solve the above problem, according to a second aspect of the present invention, there is provided an in-plane switching type active matrix type liquid-crystal display unit, comprising:

first and second scanning lines that do not intersect with each other;

a date line that intersects with said first and second scanning lines;

an earth line that intersects with said first and second scanning lines but does not intersect with said data line;

a pair of first and second electrodes that hold liquid crystal therebetween; and first to fourth switching circuits, in which said first and second electrodes and said first to fourth switching circuits are disposed in a region surrounded by said first and second scanning lines, said data line and said earth line, and are disposed on the same substrate;

wherein said first to fourth switching circuits include a circuit having at least one transistor connected in series, respectively;

wherein in transistors connected in series in said first switching circuit, a source of a first transistor is connected to said data line, gates of all the transistors are connected to said first scanning line;

wherein in transistors connected in series in said second switching circuit, a source of a first transistor is connected to said earth line, gates of all the transistors are connected to said second scanning line;

wherein in said first and second switching circuits, drains of final transistors are connected to said first electrode, respectively;

wherein in transistors connected in series in said third switching circuit, a source of a first transistor is connected to said data line, gates of all the transistors are connected to said second scanning line;

wherein in transistors connected in series in said fourth switching circuit, a source of a first transistor is connected to said earth line, gates of all the transistors are connected to said first scanning line; and wherein in said third and fourth switching circuits, drains of final transistors are connected to said second electrode, respectively.

Further, in order to solve the above problem, according to a third aspect of the present invention, there is provided a method of driving the in-plane switching type active matrix type liquid-crystal display unit mentioned in said second aspect of the present invention, characterized in that pulses are not supplied to said first and second scanning lines simultaneously.

Still further, in order to solve the above problem, according to a fourth aspect of the present invention, there is provided a method of driving the in-plane switching type active matrix type liquid-crystal display unit mentioned in said second aspect of the present invention, characterized in that a potential level of a signal inputted to said data line is always of a single polarity.

The above and other objects and features of the present invention will be more apparent from the following description taken in conjunction with the accompanying drawings.

BRIEF DESCRIPTION OF THE DRAWINGS

FIG. 9 is a diagram showing the operation of the conventional active matrix type liquid-crystal display unit (field inversion mode);

FIG. 10 is a diagram showing the operation of the conventional active matrix type liquid-crystal display unit (line inversion mode); and FIGS. 11A to 11D are diagrams showing the concept of field inversion (frame inversion), line inversion and dot inversion.

DETAILED DESCRIPTION OF THE PREFERRED EMBODIMENTS

Now, a description will be given in more detail of preferred embodiments of the present invention with reference to the accompanying drawings.

Hereinafter, an embodiment of the present invention will be described with reference to FIG. 1.

Figure 1A:
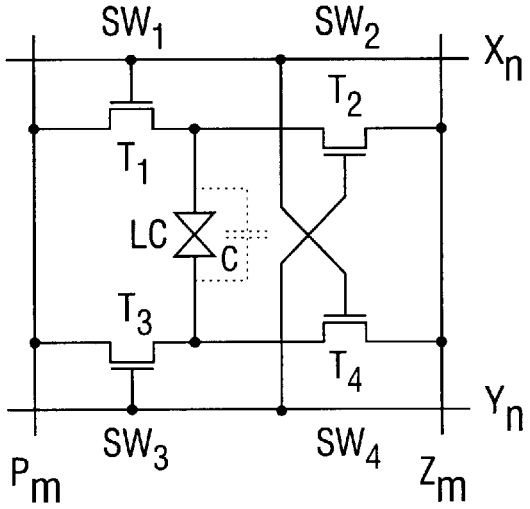
FIGS. 1A and 1B are diagrams showing a basic structure of the present invention.

The circuit structure of a unit pixel (n-th row, m-th column) in a liquid-crystal display unit in accordance with the present invention is shown in FIG. 1A. In the structure shown in FIG. 1A, first to fourth switching circuits SW1 to SW4 are made up of a single transistor ($T_1$ to $T_4$) respectively.

As in the conventional IPS system, a data line $P_m$ as well as an earth line $Z_m$ is disposed, but differently from the conventional IPS system, the earth line is so designed as not to intersect with the data line. This is because in the present invention, the earth line is required to be connected to a drain of another transistor. It should be noted that in the present invention, the source and the drain of the transistor can be entirely arbitrarily defined. Therefore, one can be appropriately defined as a source (or a drain), and in this case, the other is defined as a drain (or source) They are not distinct from each other depending on the level of a potential as usually defined.

In the present invention, two scanning lines are disposed for each line, which are different from the conventional IPS system. The sources of transistors $T_1$ and $T_3$ are in contact with the data line $P_m$. Transistors $T_1$ and $T_3$ connected to the data line $P_m$ are called "input transistors". The gates of the input transistors $T_1$ and $T_3$ are connected to different scanning lines, respectively, so that those transistors are controlled independently. In other words, the transistor $T_1$ is controlled by the scanning line $X_n$ whereas the transistor $T_3$ is controlled by the scanning line $Y_n$.

Further, the sources of the transistors $T_2$ and $T_4$ are in contact with the same earth line $Z_m$. The transistors $T_2$ and $T_4$ are called "exhaust transistors". The drains of the transistors $T_1$ and $T_2$ are connected to each other whereas the drains of the transistors $T_3$ and $T_4$ are connected to each other, and a liquid-crystal element LC of the IPS system is disposed between the drains. The liquid-crystal element LC is made up of a pair of first electrodes that hold liquid crystal therebetween, and the drain of the transistors $T_1$ and $T_2$ are connected to one electrode of the liquid-crystal element LC whereas the drain of the transistors $T_3$ and $T_4$ are connected to the other electrode of the liquid-crystal element LC. It should be noted that an auxiliary capacity C may be disposed in parallel with the liquid-crystal element LC.

The gate of the transistor $T_2$ is connected to the scanning line $Y_n$, and the gate of the transistor $T_4$ is connected to the scanning line $X_n$ so that the transistor $T_2$ is controlled by the scanning line $Y_n$, and the transistor $T_4$ is controlled by the scanning line $X_n$ (FIG. 1A)

As a result of having the above structure, the transistors $T_1$ and $T_4$ are driven simultaneously, and the transistors $T_2$ and $T_3$ are driven simultaneously.

Figure 1B:
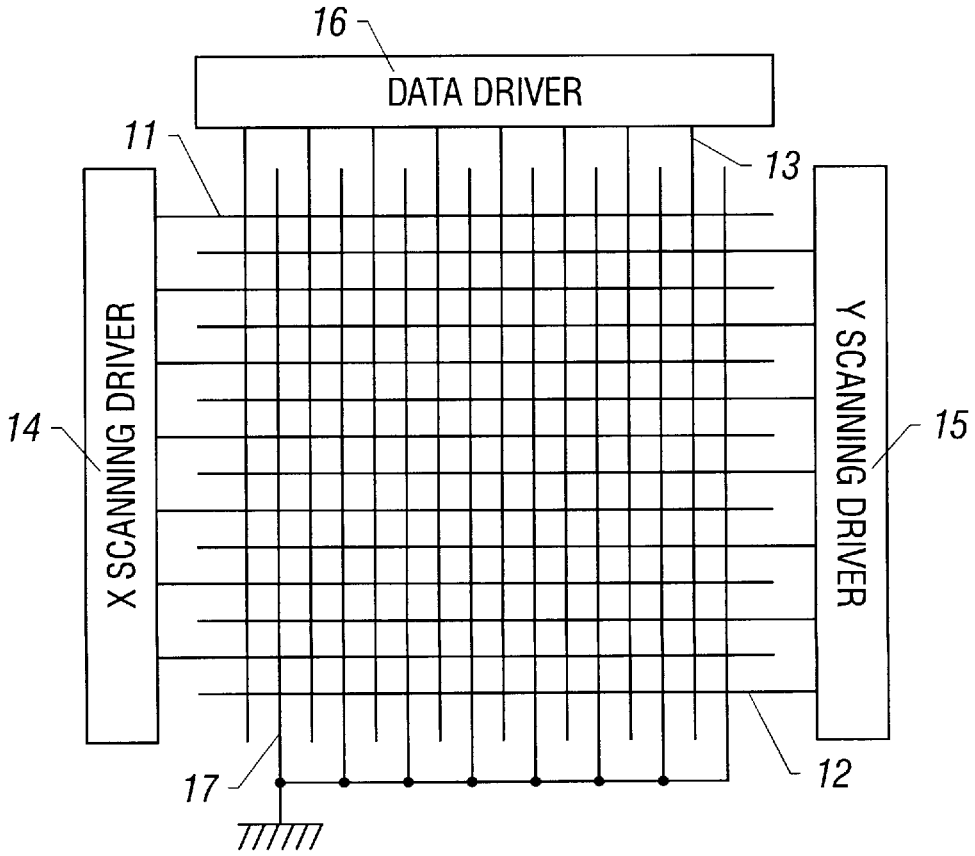

The appearance of a matrix in which a large number of unit elements with the above structure are arranged is shown in FIG. 1B. X-scanning lines 11 ($X_1, X_2, X_3, \ldots X_{N-1}, X_N$), Y-scanning lines 12 ($Y_1, Y_2, Y_3, \ldots Y_{N-1}, Y_N$), and data lines 13 ($P_1, P_2, P_3, \ldots P_{M-1}, P_M$) are controlled by an X-scanning driver 14, a Y-scanning driver 15, and a data driver 16 (in the case of N-row and M-column matrix).

An earth line 17 may be structured to be fixed to a given potential, for example, may be fixed to earth potential, since no voltage is particularly applied thereto. In FIG. 1B, the X-scanning driver 14 and a Y-scanning driver 15 are written as separate parts, but may be integrated together (FIG. 1B).

Figure 2A:
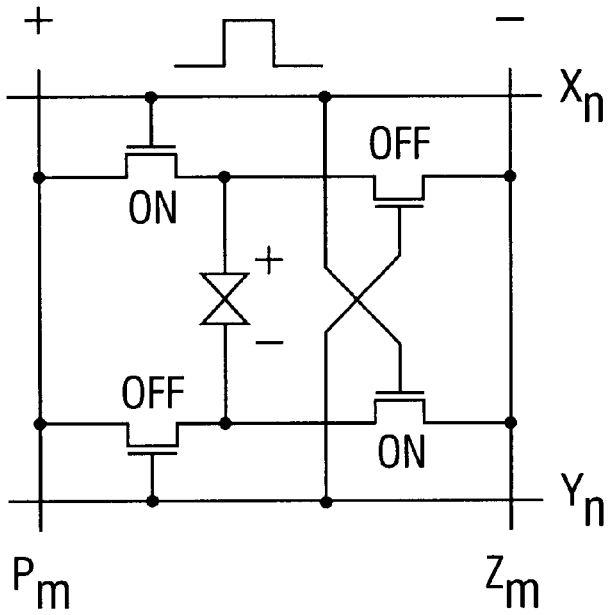
FIGS. 2A and 2B are diagrams showing the operational principle of a unit pixel having the structure of the present invention.

The operation of the unit pixel shown in FIG. 1 will be described with reference to FIG. 2. For simplification of description, it is assumed that the data line $P_m$ is held constant in a given positive potential. Actually, a signal corresponding to image information is applied to the data line $P_m$. On the other hand, it is assumed that the earth line $Z_m$ is held constant in negative potential. Let us consider a state in which a pulse $S_p$ is applied to the scanning line $X_n$. In this case, the transistors $T_1$ and $T_4$ are turned on while other transistors are held off. Therefore, the potential of the liquid-crystal element (LC), as shown in FIG. 2A, is positive in an electrode on the upper side of the figure (at the side connected the transistor $T_1$) and negative in an electrode on the lower side (at the side connected to the transistor $T_3$) (FIG. 2A).

Figure 2B:
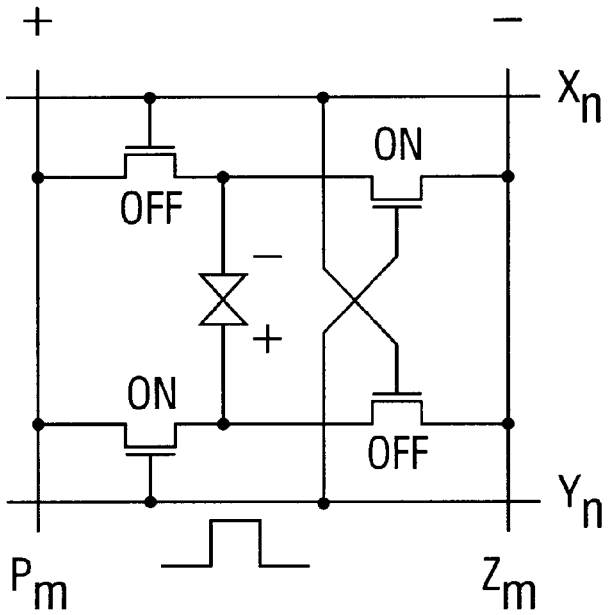

When the application of pulses $S_p$ from the scanning line $X_n$ stops, all the transistors $T_1$ to $T_2$ are turned off, but charges stored in the liquid-crystal element LC is held. Subsequently, let us consider a state in which a pulse is applied to the scanning line $Y_n$. In this case, the transistors $T_2$ and $T_3$ are turned on while other transistors are held off. Therefore, the potential of the liquid-crystal element LC, as shown in FIG. 2B, is negative in an electrode on the upper side of the figure (at the side connected the transistor $T_1$) and positive in an electrode on the lower side (at the side connected to the transistor $T_2$). That is, the polarity is reverse to the case of FIG. 2A (FIG. 2B).

As described above, even though the polarity of an image signal applied to the data line $P_m$ is single, the orientation of an electric field applied the liquid-crystal element LC can be reversed, which is the feature of the present invention. Hence, the variation of data potential can be reduced to the half, which is a problem to be solved by the present invention.

It should be noted that in the present invention, there is no possibility that all the transistors are turned on by applying pulses to the X-scanning line and the Y-scanning line simultaneously.

Also, in the active matrix type display unit according to the present invention, if the first scanning line and the second scanning line are non-selected, all the switching circuits are turned off, and the first and second electrodes are disconnected from the data line and the earth line so that charges held between the first and second electrodes can be suppressed from being leaked.

This effect can be satisfactorily obtained even in the case where the first to fourth switching circuits $SW_1$ to $SW_4$ are made up of a single transistor, respectively.

Furthermore, with such a structure that the first to fourth switching circuits $SW_1$ to $SW_4$ are made up of a plurality of thin-film transistors connected in series, because a resistor is connected in series to the first or second electrode, a leakage of charges held between the first or second electrodes can be more suppressed.

Figure 5A:
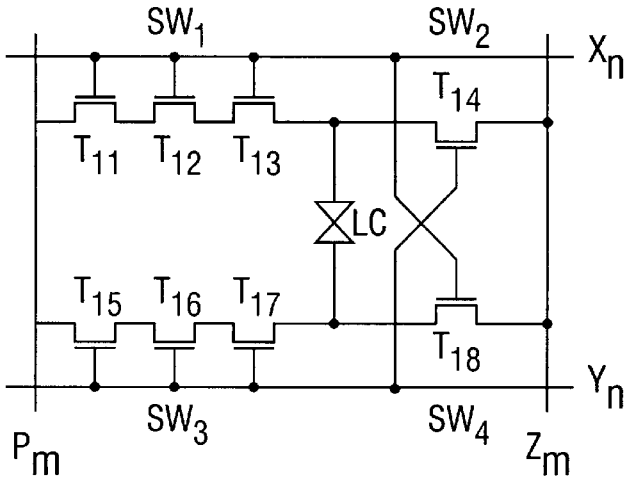
FIGS. 5A to 5C are diagrams showing another structure of the present invention.
Figure 5B:
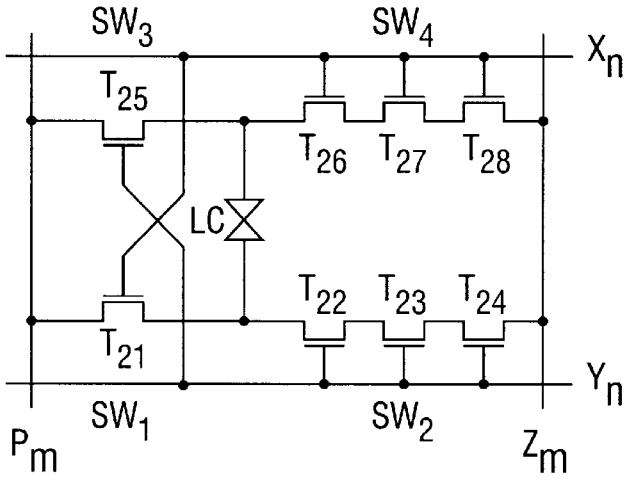
Figure 5C:
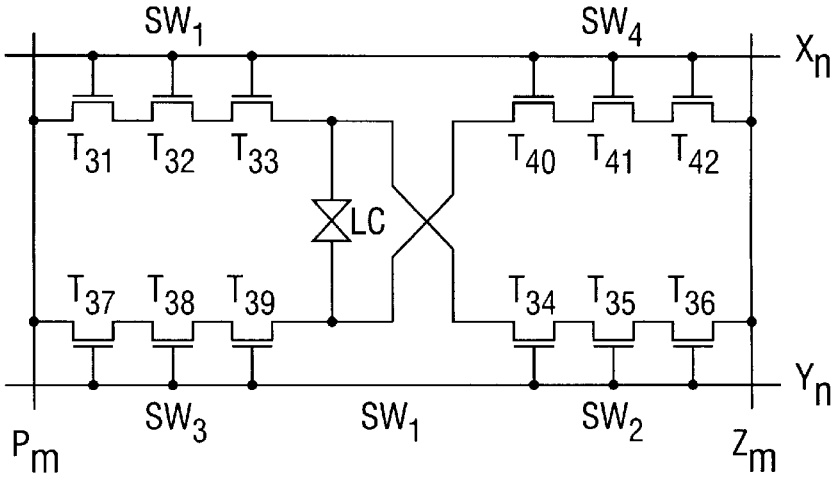
Figure 6:
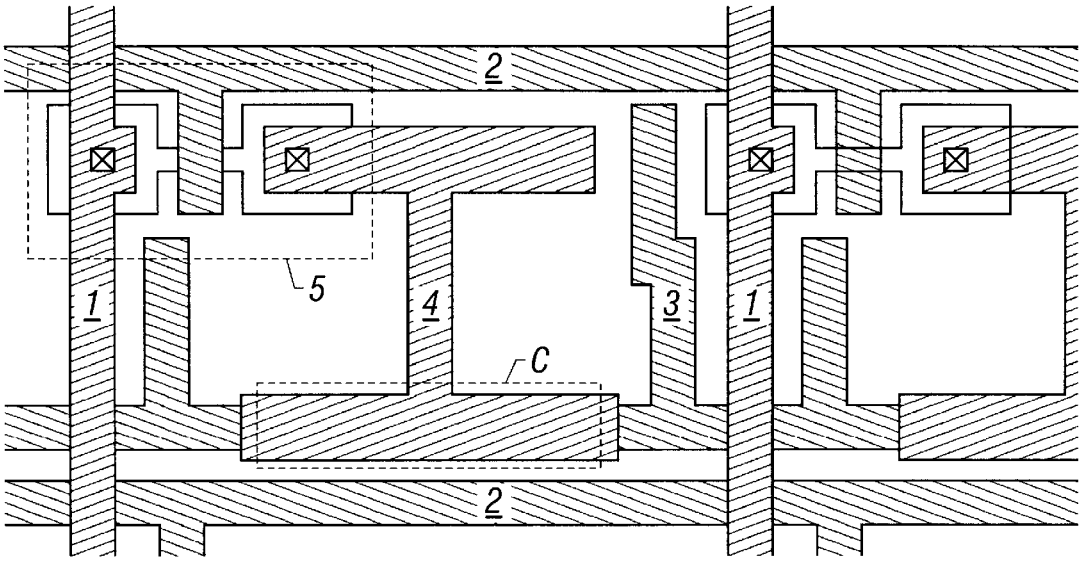
FIG. 6 (PRIOR ART)
FIG. 6 is a diagram showing a unit pixel of a conventional IPS system.
Figure 7:
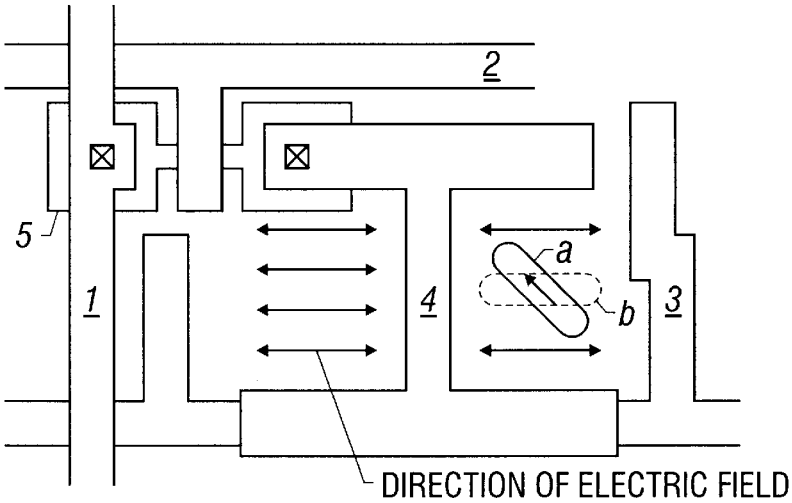
FIG. 7 (PRIOR ART)
FIG. 7 is a diagram showing the operational principle of a conventional IPS system.

FIGS. 5A to 5C show another embodiment of the present invention. In the unit pixel shown in FIG. 1, the switching circuits $SW_1$ to $SW_4$ are made up of a single thin-film transistor. FIGS. 5A to 5C show that the switching circuits $SW_1$ to $SW_4$ are made up of a plurality of thin-film transistors connected in series.

In the present specification, a plurality of thin-film transistors connected in series are so designed that all the gates are connected to the same scanning line, and the sources and the drains of the adjacent transistors are connected to each other.

Further, another embodiment of the present invention will be described with reference to FIG. 1.

FIG. 1 shows an active matrix type liquid-crystal display unit including a liquid-crystal element LC which is made up of a pair of first and second electrodes holding liquid crystal therebetween, polarity control means including a circuit which is connected to the first and second electrodes, alternately supplies an image write signal to any one of the first and second electrodes in a predetermined period of the scanning line ($X_n$, $Y_n$), the transistors ($T_1$ to $T_2$) and the earth line ($Z_m$) and sets the other electrode to a reference potential, to conduct display according to the image signal of a single polarity.

FIG. 5A shows that the first and third switching circuits $SW_1$ and $SW_3$ are made up of three thin-film transistors ($T_{11}$, $T_{12}$, $T_{13}$) and three thin-film transistors ($T_{15}$, $T_{16}$, $T_{17}$) being connected in series, respectively. Also, the thin-film transistors $T_{14}$ and $T_{18}$ correspond to the second and fourth switching circuits $SW_2$ and $SW_4$.

FIG. 5B shows that the second and fourth switching circuits $SW_2$ and $SW_4$ are made up of three thin-film transistor groups ($T_2$2, $T_2$3, $T_2$4) and three thin-film transistor groups ($T_2$6, $T_2$7, $T_2$8) being connected in series, respectively. Also, the thin-film transistors $T_2$1 and $T_2$5 correspond to the first and third switching circuits $SW_1$ and $SW_3$.

FIG. 5C shows that the first and third switching circuits $SW_1$ and $SW_3$ are made up of three thin-film transistor groups (T31, T32, T33), (T37, T38, T39) being connected in series, and further the second and fourth switching circuits $SW_2$ and $SW_4$ are made up of three thin-film transistor groups (T34, T35, T36), (T40, T41, T42) being connected in series.

EXAMPLE 1

Figure 3:
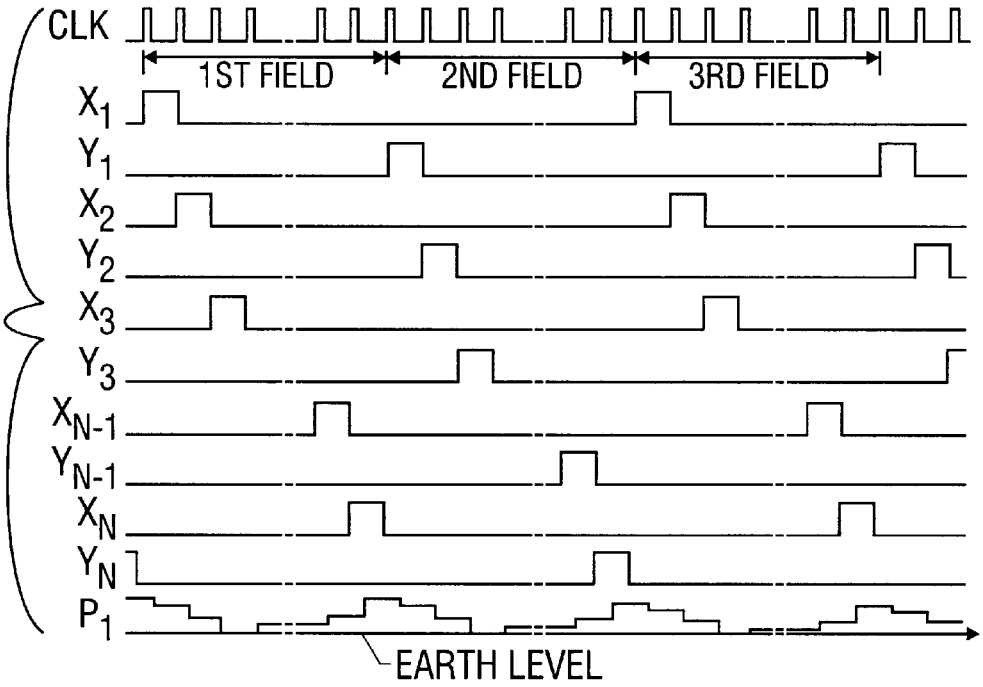
FIG. 3 is a diagram showing the operation of an embodiment (field inversion mode)

FIG. 3 shows an example in which field inversion is conducted in an n-row matrix liquid-crystal display unit in accordance with the present invention. As shown in the figure, in a first field, pulses are sequentially applied to X-scanning lines ($X_1$, $X_2$, $X_3$, . . . $X_{N-1}$, $X_N$). However, no pulses are applied to Y-scanning lines ($Y_1$, $Y_2$, $Y_3$, . . . $Y_{N-1}$, $Y_N$) at all. On the other hand, a signal of potential of earth level (potential of the earth line) or higher is applied to the date line (in this example, only $P_1$ is shown but other data lines are also the same). In this case, a state shown in FIG. 2A is realized.

On the other hand, in a second field, conversely to the first field, pulses are sequentially applied to Y-scanning lines ($Y_1$, $Y_2$, $Y_3$, . . . $Y_{N-1}$, $Y_N$). However, no pulses are applied to X-scanning lines ($X_1$, $X_2$, $X_3$, . . . $X_{N-1}$, $X_N$) at all. The data on the data line is the same as that of the first field.

In this case, a state shown in FIG. 2B is realized. In other words, an electric field applied to the liquid-crystal element LC are inverted between the first field and the second field. The same is applied between the second and third fields. In this embodiment, since any state of FIGS. 2A and 2B are realized on all lines, field inversion is conducted (FIG. 3).

EXAMPLE 2

Figure 4:
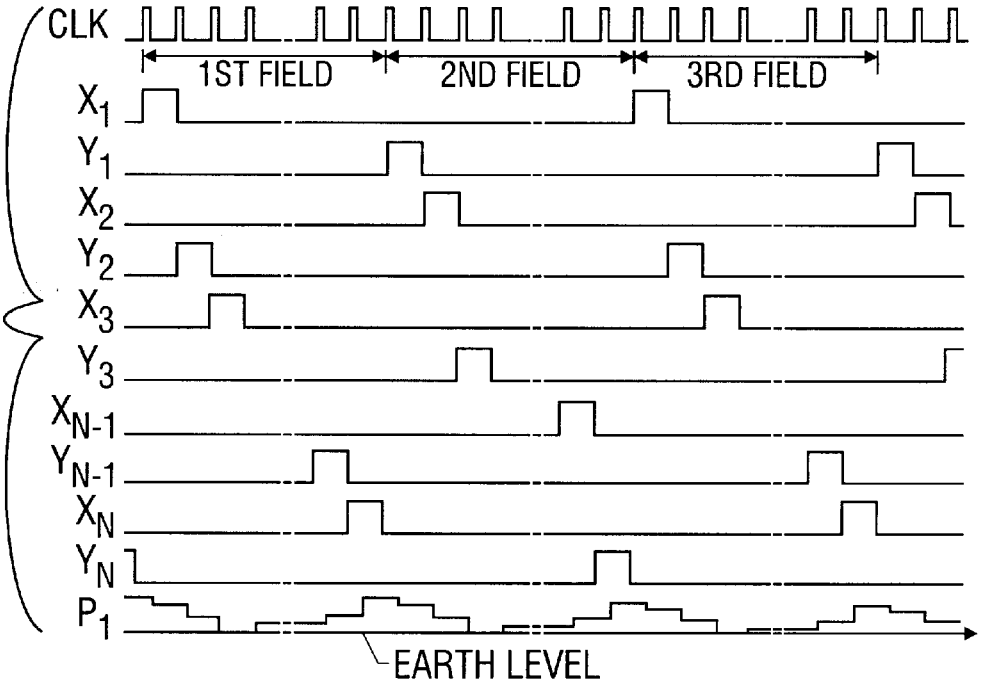
FIG. 4 is a diagram showing the operation of an embodiment (line inversion mode)

FIG. 4 shows an example in which field inversion is conducted in an n-row matrix liquid-crystal display unit in accordance with the present invention. As shown in the figure, in a first field, pulses are applied to only odd lines such as $X_1$, $X_3$, . . . $X_N$ of X-scanning lines, and pulses are applied to only even lines such as $Y_2$, $Y_4$(not shown), . . . $Y_{N-1}$ of Y-scanning lines, so that no pulses are applied to other scanning lines. On the other hand, a signal of potential of earth level (potential of the earth line) or higher is applied to the date line (in this example, only $P_1$ is shown but other data lines are also the same).

In this case, a state shown in FIG. 2A is realized on the odd lines (first, third, . . . n-th lines), and a state shown in FIG. 2B is realized on the even lines (second, fourth, . . . (N−1)th).

On the other hand, in the second field, conversely to the first field, pulses are applied to only odd lines such as $Y_1$, $Y_3$, . . . $Y_N$ of Y-scanning lines, and pulses are applied to only even lines such as $X_2$, $X_4$, . . . $X_{N-1}$ of X-scanning lines, so that no pulses are applied to other scanning lines. Data on data line is the same as that of the first field.

In this case, a state shown in FIG. 2B is realized on the odd lines (first, third, . . . n-th lines), and a state shown in FIG. 2A is realized on the even lines (second, fourth, . . . (N−1)th). In other words, when an attention is paid to a specific line, the orientation of an electric field applied to a liquid-crystal element (LC) are inverted between the first field and the second field. Also, in this embodiment, since the orientation of an electric field applied to a liquid-crystal element (LC) are inverted between the even lines and the odd lines, line inversion is conducted (FIG. 4).

EXAMPLE 3

In the unit pixel shown in FIG. 1, the switching circuits $SW_1$ to $SW_4$ are made up of a single thin-film transistor $T_1$ to $T_4$, respectively. In this example, the switching circuits $SW_1$ to $SW_4$ are made up of a plurality of thin-film transistors connected in series. FIGS. 5A to 5C are diagrams showing circuit structures of this example. The symbols identical with those in FIG. 1 represent the same member in FIGS. 5A to 5C. Also, in FIGS. 5A to 5C, the symbols $T_{r1}$ to $T_{r4}$ denote a thin-film transistor group having the same function as that of the thin-film transistor ($T_1$ to $T_4$) shown in FIG. 1.

FIG. 5A shows that the first and third switching circuits $SW_1$ and $SW_3$ are made up of three thin-film transistors (T11, T12, T13) and three thin-film transistors (T15, T16, T17) which are connected in series, respectively.

Because the gates of three thin-film transistors (T11, T12, T13) and three thin-film transistors (T15, T16, T17)are connected to the same scanning line (Xn, Yn), respectively, all the thin-film transistor groups (T11, T12, T13) and (T15, T16, T17) are simultaneously turned on/off. Accordingly, a timing at which the switching circuit shown in FIG. 5A is driven is the same as the circuit shown in FIG. 1.

Because the gates of the thin-film transistor groups (T11, T12, T13) and (T15, T16, T17) are connected to the same scanning line $X_n$, $Y_n$, respectively, the driving timing is the same as that of the input transistors T1 and T3 shown in FIG. 1.

In FIG. 5A, because the thin-film transistor groups (T11, T12, T13) and (T15, T16, T17) being connected to the data line $P_m$ are made up of the thin-film transistors of the same number, that is, because the switching circuits having the same function are made up of the thin-film transistors of the same number, even though the orientation of an electric field of a liquid-crystal element LC is varied, display can be conducted with the same characteristic even in any state of electric fields.

FIG. 5B shows that the second and fourth switching circuits $SW_2$ and $SW_4$ are made up of three thin-film transistor group ($T_2$2, $T_2$3, $T_2$4) and three thin-film transistor group ($T_2$6, $T_2$7, $T_2$8) being connected in series, respectively. Also, the thin-film transistor $T_2$1 and $T_2$5 correspond to the first and third switching circuits $SW_1$ and $SW_3$.

Because the gates of thin-film transistors ($T_2$2, $T_2$3, $T_2$4) and thin-film transistors ($T_2$6, $T_2$7, $T_2$8)are connected to the same scanning line (Xn, Yn), respectively, the driving timing is the same as that of the exhaust transistors $T_2$ nd $T_4$ shown in FIG. 1.

In FIG. 5B, because the thin-film transistor groups ($T_2$2, $T_2$3, $T_2$4) and ($T_2$6, $T_2$7, $T_2$8) being connected to the earth line $Z_m$ are made up of the thin-film transistors of the same number, that is, because the switching circuits having the same function are made up of the thin-film transistors of the same number, even though the orientation of an electric field of a liquid-crystal element LC is varied, display can be conducted with the same characteristic even in any state of electric fields.

FIG. 5C shows that the first and third switching circuits $SW_1$ and $SW_3$ are made up of three thin-film transistor group (T31, T32, T33) and three thin-film transistor group (T37, T38, T39) being connected in series, respectively, and the second and fourth switching circuits $SW_2$ and $SW_4$ are made up of three thin-film transistor group (T34, T35, T36) and three thin-film transistor group (T40, T41, T42) being connected in series, respectively.

In addition, in FIG. 5C, all the switching circuits are made up of the thin-film transistor of the same number, respectively.

Hence, the characteristics of the switching circuits connected with the liquid-crystal display LC can be made more uniform.

As was described above, according to the present invention, the orientation of an electric field applied to a liquid-crystal element can be inverted without inversion of the polarity of data. As a result, the drive voltage for a data driver can be reduced to half of the drive voltage required for the conventional display unit, and the active matrix type liquid-crystal display unit of the present invention is effective in a reduction of power consumption. Further, the effects obtained by application of the present invention also appear in a drive circuit for a scanning driver or a transistor used for an active matrix.

Figure 8:
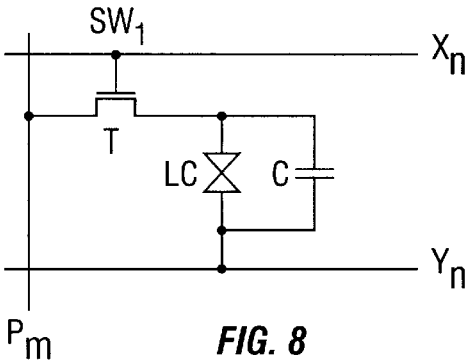
FIG. 8 (PRIOR ART)
FIG. 8 is a diagram showing the structure of a unit pixel of a conventional active matrix type liquid-crystal display unit.

For example, in the active matrix circuit (refer to FIG. 8) using the conventional drive system, because the potential of an electrode of an opposite substrate for a pixel is held constant, for example, if the potential of an electrode of the opposite substrate is set to 0 V, and data for image display is within 5 V, then the potential of data outputted from a data driver has varied with the potential difference of 10 V which is from +5 V to −5 V. In other words, the potential difference between the source and the drain of the transistor has become 10 V at the maximum.

As a result, in order to stably make the transistor off at the non-selection time, the potential of the gate electrode of the transistor has been required to be set to −5 V or less (hereinafter, a description is applied to only NMOS; in case of PMOS, the potential is +5 V or more), preferably to −7 V or less, normally to about −8 V.

Also, in order to surely make the transistor in an on-state at the selection time, the potential of the gate electrode has been required to be set to a value obtained by adding a threshold value voltage Vth to +5 V, that is, +(Vth+5) or more, preferably, +(Vth+7) or more, normally about +8 V. For that reason, the maximum potential difference between the source and the drain of the transistor becomes 10 V, and the maximum potential difference between the gate and the source of the transistor (between the gate and the drain) becomes 13 V, from which it is found that a stress very higher than a voltage required from image information is applied to the transistor. Hence, a transistor used for an active matrix is required to be a high withstand voltage transistor.

Likewise, the potential outputted from the driver is +8 V, that is, the potential difference is 16 V, thus requiring an abnormally high voltage. The output voltage of the data driver is similarly 10 V.

However, when the present invention is applied, even in the case of using the same transistor and conducting the same display, the potential of data is from 0 V to +5 V, that is, the potential difference is 5 V. Accordingly, in this situation, in order to stably make the transistor off at the non-selection time, the potential of the gate electrode of the transistor is set to 0 V or less, preferably −2 V or less, normally about −3 V. In order to surely make the transistor in the on-state at the selection time, the potential of the gate electrode is set to a value obtained by adding a threshold value voltage Vth to +5 V, that is, +(Vth+5) or more, preferably, +(Vth+7) or more, normally about +8 V.

In other words, in the transistor of the active matrix circuit according to the present invention, the maximum potential difference between the source and the drain is 5 V, and the maximum potential difference between the gate and the source (between the gate and the drain) is 8 V. Thus, the potential difference can be reduced from the potential difference 13 V of the conventional example. It may be taken that a decrease of the potential difference being 5 V does not provide so large effects.

However, the decrease of the potential difference enables a load applied to the transistor to be sufficiently reduced. In other words, it provides a remarkable effect in an improvement of the yield of the transistor. According to the inventors' experience, in the case of using silicon oxide 1200 Å in thickness as a gate insulation film, there are very little elements which are destroyed in a stage where a voltage between the gate and the source is up to 10 V. However, in the case where it is 10 V or higher, the number of destroyed elements is exponentially increased every time the voltage increases by 1 V. Hence, the fact that the voltage between the gate and the source is 10 V or less has a very significance from the industrial viewpoint.

Similarly, the potential difference outputted from the scanning driver is 11 V, which is. lower than 16 V obtained by the conventional example, thereby being capable of reducing the load applied to the scanning driver. In this way, the present invention can reduce the power consumption of not only the data driver but also the scanning driver, thereby being capable of reducing the load of the transistor used in the active matrix circuit. Particularly, regarding the latter, even a transistor which is lowered in quality to some degree can be sufficiently operated.

Further, the fact that the output voltage of the scanning driver and the data driver can be reduced means that even the load of the transistors used in those circuits can be reduced. This is effective specially in a so-called monolithic type active matrix circuit in which the scanning driver and the data driver are integrally assembled with the same substrate as that of the active matrix circuit. This is because in a circuit used in the monolithic type active matrix circuit, a thin-film transistor is generally used as in the active matrix circuit, which suffers from a difficulty in withstand voltage.

It should be noted that in the above embodiments, the transistor of the n-type (NMOS) was described as an example, however, it is needless to say that even the transistor of the p-type (PMOS) can be driven likewise. Also, the structure of the invention can be applied even to a mode such as a conventional TN. As described above, the present invention has a variety of effects for the active matrix type liquid-crystal display unit, and is useful from the industrial viewpoint.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An in-plane switching type active matrix type liquid-crystal display unit comprising:

first and second scanning lines that do not intersect with each other;

a data line that intersects with said first and second scanning lines;

an earth line that intersects with said first and second scanning lines but does not intersect with said data line;

a pair of first and second electrodes that hold liquid crystal therebetween; and first to fourth switching circuits, in which said first and second electrodes and said first to fourth switching circuits are disposed in a region surrounded by said first and second scanning lines, said data line and said earth line, and are disposed on the same substrate;

wherein said first to fourth switching circuits include a circuit having at least one transistor connected in series, respectively;

wherein in transistors connected in series in said first switching circuit, a source of a first transistor is connected to said data line, gates of all the transistors are connected to said first scanning line;

wherein in transistors connected in series in said second switching circuit, a source of a first transistor is connected to said earth line, gates of all the transistors are connected to said second scanning line;

wherein in said first and second switching circuits, drains of final transistors are connected to said first electrode, respectively;

wherein in transistors connected in series in said third switching circuit, a source of a first transistor is connected to said date line, gates of all the transistors are connected to said second scanning line;

wherein in transistors connected in series in said fourth switching circuit, a source of a first transistor is connected to said earth line, gates of all the transistors are connected to said first scanning line; and wherein in said third and fourth switching circuits, drains of final transistors are connected to said second electrode, respectively.

2. The unit of claim 1 wherein said first switching circuit and said third switching circuit comprise transistors of the same number, respectively.

3. The unit of claim 1 wherein said second switching circuit and said fourth switching circuit comprise transistors of the same number, respectively.

4. The unit of claim 1 wherein said first to fourth switching circuits comprise transistors of the same number, respectively.

5. A method of driving an in-plane switching type active matrix type liquid-crystal display unit comprising:

first and second scanning lines that do not intersect with each other;

a data line that intersects with said first and second scanning lines;

an earth line that intersects with said first and second scanning lines but does not intersect with said data line;

a pair of first and second electrodes that hold liquid crystal therebetween; and first to fourth switching circuits, in which said first and second electrodes and said first to fourth switching circuits are disposed in a region surrounded by said first and second scanning lines, said data line and said earth line, and are disposed on the same substrate;

wherein said first to fourth switching circuits include a circuit having at least one transistor connected in series, respectively;

wherein in transistors connected in series in said first switching circuit, a source of a first transistor is connected to said data line, gates of all the transistors are connected to said first scanning line;

wherein in transistors connected in series in said second switching circuit, a source of a first transistor is connected to said earth line, gates of all the transistors are connected to said second scanning line;

wherein in said first and second switching circuits, drains of final transistors are connected to said first electrode, respectively;

wherein in transistors connected in series in said third switching circuit, a source of a first transistor is connected to said date line, gates of all the transistors are connected to said second scanning line;

wherein in transistors connected in series in said fourth switching circuit, a source of a first transistor is connected to said earth line, gates of all the transistors are connected to said first scanning line; and wherein in said third and fourth switching circuits, drains of final transistors are connected to said second electrode, respectively;

characterized in that pulses are not simultaneously supplied to said third and fourth scanning lines.

6. The method of claim 5 wherein in a field in which a pulse is applied to said first scanning line, no pulse is applied to said second scanning line, and in a field subsequent to said field, no pulse is applied to said first scanning line and a pulse is applied to said second scanning line.

7. The method of claim 5 wherein in a field in which a pulse is applied to at least one first scanning line, no pulse is applied to all the second scanning lines, and in a field subsequent to the field, a pulse is applied to at least one second scanning line, and no pulse is applied to all the first scanning line.

8. The method of claim 5 wherein in a field in which a pulse is applied to a first scanning line on an arbitrary line, no pulse is applied to a second scanning line on said arbitrary line, and no pulse is applied to any first scanning lines on two lines adjacent to said arbitrary line, and pulses are applied to both the second scanning lines on two lines adjacent to said arbitrary line.

9. A method of driving an in-plane switching type active matrix type liquid-crystal display unit comprising:

first and second scanning lines that do not intersect with each other;

a data line that intersects with said first and second scanning lines;

an earth line that intersects with said first and second scanning lines but does not intersect with said data line;

a pair of first and second electrodes that hold liquid crystal therebetween; and first to fourth switching circuits, in which said first and second electrodes and said first to fourth switching circuits are disposed in a region surrounded by said first and second scanning lines, said data line and said earth line, and are disposed on the same substrate;

wherein said first to fourth switching circuits include a circuit having at least one transistor connected in series, respectively;

wherein in transistors connected in series in said first switching circuit, a source of a first transistor is connected to said data line, gates of all the transistors are connected to said first scanning line;

wherein in transistors connected in series in said second switching circuit, a source of a first transistor is connected to said earth line, gates of all the transistors are connected to said second scanning line;

wherein in said first and second switching circuits, drains of final transistors are connected to said first electrode, respectively;

wherein in transistors connected in series in said third switching circuit, a source of a first transistor is connected to said date line, gates of all the transistors are connected to said second scanning line;

wherein in transistors connected in series in said fourth switching circuit, a source of a first transistor is connected to said earth line, gates of all the transistors are connected to said first scanning line; and wherein in said third and fourth switching circuits, drains of final transistors are connected to said second electrode, respectively;

characterized in that a potential level of a signal inputted to said data line is always of a single polarity.

10. The method of claim 9 wherein in a field in which a pulse is applied to at least one first scanning line, no pulse is applied to all the second scanning lines, and in a field subsequent to the field, a pulse is applied to at least one second scanning line, and no pulse is applied to all the first scanning line.

11. The method of claim 9 wherein in a field in which a pulse is applied to a first scanning line on an arbitrary line, no pulse is applied to a second scanning line on said arbitrary line, and no pulse is applied to any first scanning lines on two lines adjacent to said arbitrary line, and pulses are applied to both the second scanning lines on two lines adjacent to said arbitrary line.

12. An in-plane switching type active matrix type liquid-crystal display unit comprising:

first and second scanning lines that do not intersect with each other;

a data line that intersects with said first and second scanning lines;

an earth line that intersects with said first and second scanning lines but does not intersect with said data line;

a pair of first and second electrodes that hold liquid crystal therebetween; and first to fourth switching circuits, in which said first and second electrodes and said first to fourth switching circuits are disposed in a region surrounded by said first and second scanning lines, said data line and said earth line, and are disposed on the same substrate;

wherein said first to fourth switching circuits include a circuit having at least one transistor connected in series, respectively;

wherein among transistors connected in series in said first switching circuit, a source of a first transistor is connected to said data line, and gates of all the transistors are connected to said first scanning line;

wherein among transistors connected in series in said second switching circuit, a source of a first transistor is connected to said earth line, gates of all the transistors are connected to said second scanning line;

wherein among said first and second switching circuits, drains of final transistors are connected to said first electrode, respectively;

wherein among transistors connected in series in said third switching circuit, a source of a first transistor is connected to said date line, and gates of all the transistors are connected to said second scanning line;

wherein among transistors connected in series in said fourth switching circuit, a source of a first transistor is connected to said earth line, and gates of all the transistors are connected to said first scanning line;

wherein among said third and fourth switching circuits, drains of final transistors are connected to said second electrode, respectively, and wherein an image signal of a single polarity is supplied to said data line.

* * * * *